United States Patent [19]

Iwata

[11] Patent Number: 4,630,253

[45] Date of Patent: Dec. 16, 1986

[54] ELECTROMAGNETIC PICKUP CARTRIDGE HAVING ELONGATE CORE ELEMENTS

[75] Inventor: Tetsuya Iwata, Koide, Japan

[73] Assignee: Alps Electric Co., Ltd., Japan

[21] Appl. No.: 139,421

[22] Filed: Apr. 11, 1980

Related U.S. Application Data

[63] Continuation of Ser. No. 971,482, Dec. 20, 1978, abandoned.

[30] Foreign Application Priority Data

Dec. 23, 1977 [JP] Japan ..... 52-156022

[51] Int. Cl.[4] ..... H04R 11/12

[52] U.S. Cl. ..... 369/136; 369/146; 369/149

[58] Field of Search ..... 179/100.41 K, 100.41 M, 179/100.41 Z; 274/37; 369/135, 136, 146, 147, 148, 149

[56] References Cited

U.S. PATENT DOCUMENTS

| | | | |
|---|---|---|---|
| 3,062,925 | 11/1962 | Pritchard | 179/100.41 K |
| 3,294,405 | 12/1966 | Pritchard | 179/100.41 K |
| 3,627,931 | 12/1971 | Matsuda | 179/100.41 K |

FOREIGN PATENT DOCUMENTS

| | | | |
|---|---|---|---|
| 0927149 | 5/1963 | United Kingdom | 179/100.41 K |
| 1233791 | 5/1971 | United Kingdom | 179/100.41 K |
| 1381888 | 1/1975 | United Kingdom . | |
| 1505884 | 3/1978 | United Kingdom . | |
| 1520337 | 8/1978 | United Kingdom . | |

*Primary Examiner*—Robert L. Richardson
*Attorney, Agent, or Firm*—Guy W. Shoup

[57] ABSTRACT

Disclosed in a high-performance electromagnetic pickup cartridge with little distortion, comprising a stylus attached to the end of a cantilevered arm, a disk type armature magnetized in its axial direction and secured to the arm, and bar type magnetic core elements disposed in the vicinity of the armature so that they are at right angles to the axis of the cantilevered arm and correspond to each channel of a stereophonic record. When the armature is vibrated, an output signal is generated in respective coils wound around the core elements. Because of the above-described construction, the core elements need only have a bar-shaped configuration without the necessity for opposing faces between which a magnet or an iron piece would otherwise have to be inserted.

2 Claims, 8 Drawing Figures

ELECTROMAGNETIC PICKUP CARTRIDGE HAVING ELONGATE CORE ELEMENTS

This application is a continuation of my copending application Ser. No. 971,482 filed Dec. 20, 1978 now abandoned.

BACKGROUND OF THE INVENTION

1. Field of the Invention

The present invention relates to electromagnetic pickup cartridges and, more particularly, to electromagnetic pickup cartridges suitable for use with stereophonic records.

2. Description of the Prior Art

Electromagnetic pickup cartridges include what have been termed moving-magnet type cartridges or moving-iron type cartridges having either a magnet or an iron piece inserted in a gap formed between the faces of opposing poles. The opposing poles are typically the end portions of a yoke element forming the core of an electromagnetic circuit. The magnet or iron piece is typically connected to a stylus contacting a recording groove in a record so that the magnet or iron piece is vibrated within the gap to thereby vary the total magnetic flux flowing in the electromagnetic circuit and generate an output voltage in coils wound around the yoke elements. For a stereophonic pickup cartridge, two sets of opposing poles are positioned orthognally to one another to form a common gap, and each set is related to a respective electromagnetic circuit.

In these moving-magnet or moving-iron type electromagnetic pickup cartridges, particularly in those designed for stereophonic use, a lack of precision in the dimensions of the common gap directly causes crosstalk distortion between the separate channels. Moreover, these pickup cartridges often have a complicated construction and the magnet or iron piece must be inserted in the gap with great precision. Consequently, it is often expensive to manufacture such pickup cartridges and to provide them with the channel separation necessary for today's market.

SUMMARY OF THE INVENTION

An object of the present invention is to provide a high-quality electromagnetic pickup cartridge in which the above-mentioned drawbacks encountered in conventional moving-magnet and moving-iron type electromagnetic pickup cartridge are eliminated.

Another object of the present invention is to provide a high-quality electromagnetic pickup cartridge with little distortion which can be simply designed and manufactured readily at low cost.

According to the present invention, an electromagnetic pickup cartridge for converting mechanical vibrations induced from the undulating side walls of a stereophonic recording groove into respective electrical output signals comprises a generally disk shaped armature magnetized axially to provide a generally uniform magnetic field about its rim portion. A cantilevered arm carries a stylus and extends coaxially from the armature. Elongate core elements extend orthongonally through the lines of force of the magnetic field so that the longitudinal component of the flux through the core elements will vary the output in coils wound about the core elements as the armature is vibrated.

The above and other objects as well as advantageous features of the invention will become more apparent from the following description of the preferred embodiments taken in conjunction with the accompanying drawings.

DESCRIPTION OF THE PREFERRED EMBODIMENT

An embodiment of the present invention will be described below with reference to the accompanying drawings.

Figure 2A:
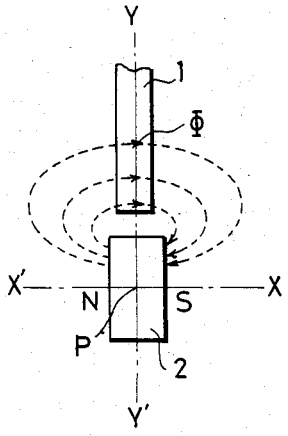
FIGS. 2A–2C are explanatory diagrams of the principle of operation for the embodiment of FIG. 1.
Figure 2B:
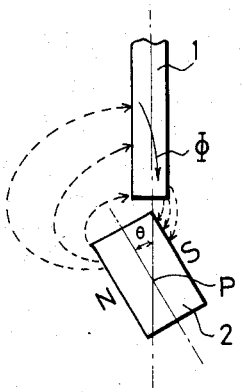
Figure 2C:
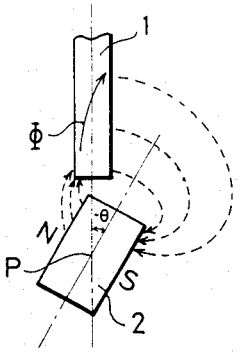

First, the principle of generation of electric power in the present invention will be described with reference to FIG. 2. Reference numeral 1 denotes a bar formed of magnetic material such as permalloy, and 2 denotes a disk type armature. Referring to FIG. 2A, the armature 2 is magnetized in the direction of an X–X′ axis which is at right angles to the longitudinal or Y–Y′ axis of the bar 1. The center point P of the armature 2 is magnetically neutral and coincides with the intersection of the axes X–X′, Y–Y′. The armature 2 may be vibrated in a pivotal manner about its center point P. FIG. 2A shows the armature 2 prior to vibration. Regarding the distribution of the magnetic field in this case, the magnetic flux flows through the bar 1 in a direction generally at right angles to the longitudinal axis thereof and there is little or no component of the magnetic flux in the direction of the Y–Y′ axis. However, when the armature 2 is pivoted counter-clockwise by an angle $\theta$ from its initial position, as shown in FIG. 2B, the S-pole of the armature 2 moves towards the lower end of the bar 1 while the N-pole moves away from the bar. The magnetic field cutting through the bar 1 is thus shifted as shown in FIG. 2B. At this time, a magnetic flux having a Y–Y′ component (directed to the bottom of the drawing) is produced in the bar 1. FIG. 2C shows the direction of magnetic flux (directed to the top of the drawing) occurring when the armature 2 is pivoted clockwise or in the opposite direction by an angle $\theta$ so that the N-pole of the armature 2 approaches the end of the bar 1. When the armature 2 is magnetized in the opposite direction or in the direction of the Y–Y′ axis, an equivalent effect is obtained since the magnetic field has symmetrical characteristics.

Figure 3A:
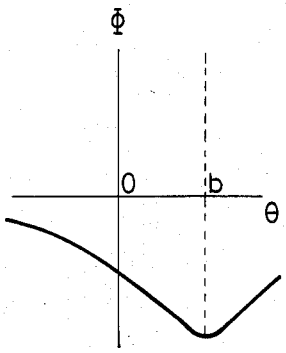
FIGS. 3A–3C are graphs showing the interrelation between the magnetic flux $\Phi$ flowing in the core elements and the angle $\theta$ of inclination of the armature of the embodiment of FIG. 1.
Figure 3B:
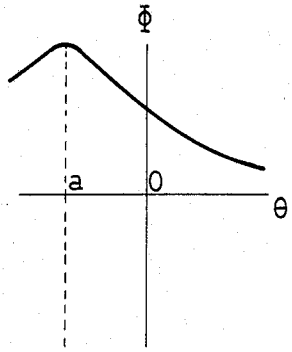
Figure 3C:
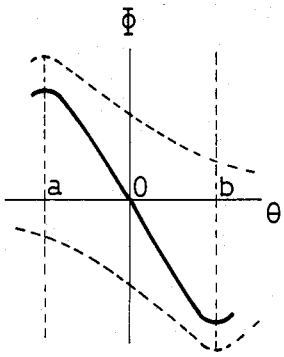

FIG. 3 shows the interrelation between the magnetic flux flowing in the bar 1 and having a Y–Y′ component and the angle $\theta$ of inclination of the armature 2. FIG. 3A shows the Y–Y′ component (which is smallest when $\theta$ is b) of the magnetic flux due to the S-pole of the armature 2 when the armature 2 is inclined about the center point P by an angle $\theta$ with respect to the Y–Y′ axis. FIG. 3B shows the Y–Y′ component (which is largest when $\theta$ is a) of the magnetic flux due to the N-pole of the armature 2. FIG. 3C shows the Y–Y′ component (indicated by the solid line) obtained by combining the magnetic flux due to the N and S-poles. As can be clearly understood from these graphs, the magnetic flux of the Y–Y′ component varies linearly when the angle $\theta$ of inclination of the armature is between a and b.

Figure 4:
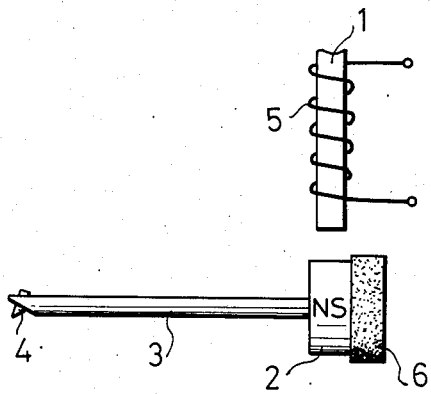
FIG. 4 is a cross-sectional view of a principal portion of the electric signal generating mechanism in the embodiment of FIG. 1.

FIG. 4 illustrates essential parts of a pickup cartridge utilizing the principles outlined above. A needle or stylus 4 is attached to the free end of a cantilevered arm 3 which is secured to the disk type magnet armature 2. The arm 3 extends perpendicularly from the armature 2 and when the needle 4 is vibrated in a recording groove, the resulting mechanical vibrations are transmitted to the armature via the cantilevered arm 3 to vary the magnetic flux $\Phi$ passing through the bar 1. At this time, an output signal is generated as a distortion-free electric signal in a coil 5 wound around the bar 1. Reference numeral 6 denotes a damper of resilient material which facilitates the controlled vibration of the armature 2.

Figure 1:
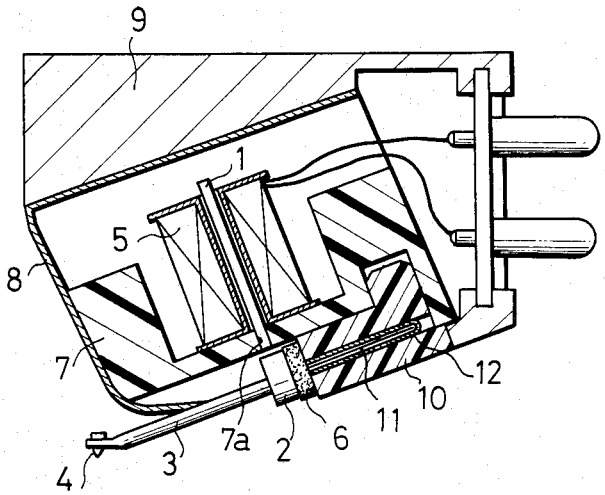
FIG. 1 is a side elevational view in cross section of an embodiment of the present invention.

Next, an embodiment of the electromagnetic pickup cartridge utilizing the above-mentioned principles of the present invention will be described with reference to FIG. 1.

A bar or core element 1 has a coil 5 wound therearound. The bar 1 has a lower end portion thereof secured fixedly in a hole *7a* in a mount 7 and faces the periphery of a disk type magnet armature 2. The armature 2 is magnetized axially and provides a magnetic field generally uniform around its rim portion. Reference numeral 8 denotes a shield case fitted in a frame 9 and enclosing the coil 5 and bar 1 to protect them against external noise. Reference numeral 10 denotes a support member for the vibrating parts, to which support member a cantilevered arm 3 having a stylus 4 at the front end thereof and an armature 2 at the rear portion thereof is secured by a damper 6 and a suspension wire 11.

The damper 6 is fitted on the rear end of the cantilevered arm 3 and contacts the support member 10 to damp the cantilevered arm 3. The suspension wire 11 is secured at one end thereof to the fulcrum of vibration of the cantilevered arm 3 and at the other end thereof to the support member 10 by means of a crimped pipe 12 accommodated in the support member. This wire prevents the cantilevered arm 3 from being pulled towards the recording groove and clearly defines the fulcrum of vibration of the cantilevered arm 3.

When this pickup cartridge is used for a stereo set, a pair of bars 1 around which respective coils are wound are disposed at right angles to one another and face each channel wall of a recording groove in a record.

The above-described embodiment is a moving-magnet type pickup cartridge using a magnet armature. However, the present invention may naturally be used in moving-iron type electromagnetic pickup cartridge, in which an iron piece magnetized by a magnet is disposed in the vicinity of the bars 1 so that the iron piece is vibrated to produce an output.

Since the pickup cartridge of the present invention has bar type magnetic elements 1 corresponding to each channel and disposed in the vicinity of a disk type armature 2 magnetized in the direction of thickness thereof, and at right angles to the axis of the cantilevered arm 3, the present invention does not require a magnet or an iron piece to be inserted precisely in the gap between opposing pole faces of yoke elements as set forth in the prior art. Namely, the bars 1 in the present invention need only to have a single face adjacent the armature and do not need opposing pole faces precisely located as in the prior art. The pickup cartridge of the present invention can therefore be designed very easily and the cost of materials and of manufacture can be reduced. Moreover, the armature 2 is not inserted in the above-mentioned gap in the present invention and dimensional precision is thus not extremely critical. Consequently, the parts can be easily manufactured and assembled. The present invention thus provides a remarkable effect, namely the provision of a low cost, high-performance electromagnetic pickup cartridge with little distortion.

Needless to say, the bar type magentic elements 1 may be made in other shapes without departing from the scope of the present invention.

The electromagnetic pickup cartridge of the present invention is not, of course, limited to the details of the above embodiment. It will be apparant that the features of the present invention may be embodied in other forms while still utilizing the substance of the present invention which is defined by the appended claims.

What is claimed is:

1. An electromagnetic pickup cartridge for converting mechanical vibrations induced from the undulating side walls of a stereophonic recording groove into respective electric output signals, comprising:

an armature magnetized axially and providing a magnetic field generally uniform around its rim portion;

a cantilevered arm extending coaxially from said armature and carrying at its free end portion a stylus adapted to ride within said recording groove to thereby vibrate said armature correspondingly; and means including coils wound about respective core elements each consisting essentially of an elongate bar having its longitudinal axis extending generally orthogonally through the lines of force of said magnetic field while said armature is at rest for providing respective output signals in response to a varying longitudinal component of the magnetic flux produced through said core elements as said armature is vibrated, each said core elements having only a single face is proximity to said armature.

2. A pickup cartridge according to claim 1, said core elements each extending generally normal to the respective plane of each side wall of the recording groove.

* * * * *